US009443666B2

(12) United States Patent
Rodrigues et al.

(10) Patent No.: US 9,443,666 B2
(45) Date of Patent: Sep. 13, 2016

(54) ELECTRICAL CONTACT DEVICE OF THE CONTACT FINGER TYPE WITH A STRONG NOMINAL CURRENT

(71) Applicant: ALSTOM Technology Ltd, Baden (CH)

(72) Inventors: Didier Rodrigues, Serpaize (FR); Denis Frigiere, Decines (FR); Jean Marc Willieme, La Mulatiere (FR); Frank Jacquier, Mions (FR)

(73) Assignee: Alstom Technology Ltd., Baden (CH)

( * ) Notice: Subject to any disclaimer, the term of this patent is extended or adjusted under 35 U.S.C. 154(b) by 0 days.

(21) Appl. No.: 14/429,761

(22) PCT Filed: Sep. 30, 2013

(86) PCT No.: PCT/EP2013/070318
§ 371 (c)(1),
(2) Date: Mar. 19, 2015

(87) PCT Pub. No.: WO2014/053429
PCT Pub. Date: Apr. 10, 2014

(65) Prior Publication Data

US 2015/0235781 A1 Aug. 20, 2015

(30) Foreign Application Priority Data

Oct. 2, 2012 (FR) ..... 12 59334

(51) Int. Cl.
*H01H 1/24* (2006.01)
*H01H 1/22* (2006.01)
*H01H 1/02* (2006.01)

(52) U.S. Cl.
CPC ..... *H01H 1/24* (2013.01); *H01H 1/02* (2013.01); *H01H 1/22* (2013.01)

(58) Field of Classification Search
CPC ..... H01H 1/24; H01H 1/02; H01H 1/22; H01H 9/102; H01H 1/221; H01H 1/44; H01H 1/48
USPC ..... 200/245, 294, 50.1, 260, 281; 337/196, 337/212
See application file for complete search history.

(56) References Cited

U.S. PATENT DOCUMENTS 1,667,652 A * 4/1928 Case ..... H01H 1/22 200/275
1,776,138 A 9/1930 Tritle
(Continued)

FOREIGN PATENT DOCUMENTS

CH 440 413 A 7/1967
DE 893684 C 10/1953
(Continued)

OTHER PUBLICATIONS

Baltensperger, P., "Switching overvoltage in HV and EHV networks", CIGRE 1970 13.14, p. 9, paragraph 5.2.2. (not translated).
(Continued)

*Primary Examiner* — Edwin A. Leon
(74) *Attorney, Agent, or Firm* — Nixon Peabody LLP; Khaled Shami

(57) ABSTRACT

An electrical contact device of the contact finger type for high nominal current between a first part that is conductive and a conductive surface of a second part comprising a flexible rod connected to a first connection element for mechanical and electrical connection to the first part, a contact portion applied on the conductive surface of the second part, and at least one metal contact blade placed at a first end between a first end of the flexible rod and the first part. The flexible rod is conductive, and the at least one metal blade is connected at its second end to the second end of the flexible rod by a second mechanical and electrical connection element.

6 Claims, 2 Drawing Sheets

(56) References Cited

U.S. PATENT DOCUMENTS

| | | | | |
|---|---|---|---|---|
| 1,896,560 | A | 2/1933 | Russell | |
| 2,008,927 | A | 7/1935 | Russell | |
| 2,636,955 | A | 4/1953 | George | |
| 3,590,186 | A | 6/1971 | Brunner | |
| 3,778,573 | A | 12/1973 | Harrold | |
| 3,943,314 | A | 3/1976 | Frink | |
| 3,970,809 | A | 7/1976 | Mitchell | |
| 3,984,651 | A | 10/1976 | Lewis et al. | |
| 4,419,552 | A | 12/1983 | Haginomori | |
| 4,617,435 | A | 10/1986 | Kawasaki | |
| 4,849,589 | A * | 7/1989 | Dickens | H01H 1/50 200/251 |
| 5,091,614 | A | 2/1992 | Yamamoto et al. | |
| 5,109,145 | A | 4/1992 | Fujita et al. | |
| 5,780,799 | A | 7/1998 | David | |
| 5,898,151 | A | 4/1999 | Plat et al. | |
| 5,905,242 | A | 5/1999 | Bernard et al. | |
| 5,952,635 | A | 9/1999 | Plat et al. | |
| 6,013,888 | A | 1/2000 | Thuries | |
| 6,211,478 | B1 | 4/2001 | Schoenemann et al. | |
| 6,492,609 | B1 | 12/2002 | Biquez et al. | |
| 6,593,538 | B2 | 7/2003 | Perret et al. | |
| 6,751,078 | B1 | 6/2004 | Munakata et al. | |
| 6,759,616 | B2 | 7/2004 | Rokunohe et al. | |
| 6,838,631 | B2 | 1/2005 | Munakata et al. | |
| 6,849,819 | B2 | 2/2005 | Tresy et al. | |
| 6,881,917 | B2 | 4/2005 | Kikukawa et al. | |
| 7,091,439 | B2 | 8/2006 | Vaghini et al. | |
| 7,199,324 | B2 | 4/2007 | Perret | |
| 7,705,262 | B2 | 4/2010 | Allaire et al. | |
| 7,718,913 | B2 | 5/2010 | Frigiere et al. | |
| 8,081,407 | B2 | 12/2011 | Willieme et al. | |
| 8,264,803 | B2 | 9/2012 | Willieme et al. | |
| 8,711,550 | B2 | 4/2014 | Frigiere et al. | |
| 8,717,745 | B2 | 5/2014 | Frigiere et al. | |
| 2012/0204590 | A1 | 8/2012 | Frigiere et al. | |
| 2012/0205074 | A1 | 8/2012 | Frigiere et al. | |
| 2015/0014279 | A1 | 1/2015 | Rodrigues | |

FOREIGN PATENT DOCUMENTS

| | | | |
|---|---|---|---|
| DE | 100 16 950 | A1 | 10/2001 |
| EP | 0 239 783 | A2 | 10/1987 |
| EP | 0 878 817 | A1 | 11/1998 |
| EP | 0 878 817 | B1 | 11/1998 |
| EP | 0877 405 | A1 | 11/1998 |
| EP | 1 005 058 | A2 | 5/2000 |
| EP | 0 982 748 | A1 | 3/2001 |
| EP | 1 108 261 | | 6/2001 |
| EP | 1 117 114 | A2 | 7/2001 |
| EP | 1 310 970 | A1 | 5/2003 |
| EP | 1 583 124 | A1 | 10/2005 |
| EP | 1 653 491 | A2 | 5/2006 |
| FR | 2738389 | A1 | 3/1997 |
| WO | WO 97/08723 | A | 3/1997 |
| WO | WO 00/05735 | A1 | 2/2000 |
| WO | WO 2013/093033 | A1 | 6/2013 |

OTHER PUBLICATIONS

European Search Report in European Patent Application No. EP 07 11 0719, mailed Aug. 16, 2007.
French Search Report in French Patent Application No. FR 0650155, mailed Oct. 18, 2006.
French Search Report in French Patent Application No. FR 0651709, mailed Jan. 16, 2007.
French Search Report in French Patent Application No. FR 0652628, mailed Feb. 20, 2007.
International Preliminary Report on Patentability in International Patent Application No. PCT/EP2012/076712, mailed Jul. 3, 2014.
International Search Report in International Patent Application No. PCT/EP2007/050318, mailed Apr. 27, 2007.
International Search Report in International Patent Application No. PCT/EP2007/050329, mailed Mar. 21, 2007.
International Search Report in International Patent Application No. PCT/EP2012/076712, mailed Mar. 28, 2013.
Office Action in U.S. Appl. No. 11/799,672, dated Jun. 16, 2009.
Notice of Allowance in U.S. Appl. No. 11/799,672, dated Dec. 17, 2009.
Notice of Allowance in U.S. Appl. No. 11/820,829, dated Jan. 8, 2010.
Office Action in U.S. Appl. No. 12/161,314, dated Sep. 14, 2010.
Office Action in U.S. Appl. No. 12/161,314, dated Apr. 4, 2011.
Notice of Allowance in U.S. Appl. No. 12/161,314, dated Aug. 18, 2011.
Office Action in U.S. Appl. No. 12/161,316, dated Sep. 15, 2010.
Office Action in U.S. Appl. No. 12/161,316, dated Apr. 12, 2011.
Office Action in U.S. Appl. No. 12/161,316, dated Oct. 26, 2011.
Notice of Allowance in U.S. Appl. No. 12/161,316, dated May 29, 2012.
Standard CE156 1987 "Normal values of assigned voltages of the line for on-line close defects".
French Search Report in French Patent Application No. FR 1259334, mailed Jun. 18, 2013.
International Preliminary Report on Patentability in International Patent Application No. PCT/EP2013/070318, mailed Jan. 3, 2014.
International Search Report and Written Opinion in International Patent Application No. PCT/EP2013/070318, mailed Dec. 20, 2013.

* cited by examiner

ELECTRICAL CONTACT DEVICE OF THE CONTACT FINGER TYPE WITH A STRONG NOMINAL CURRENT

CROSS-REFERENCE TO RELATED PATENT APPLICATIONS

The present application is a National Stage Application of International Application No. PCT/EP2013/070318 entitled "ELECTRICAL CONTACT DEVICE OF THE CONTACT FINGER TYPE WITH A STRONG NOMINAL CURRENT" filed Sep. 30, 2013, which claims priority of French Patent Application No. 1259334, filed Oct. 2, 2012, the contents of each incorporated herein by reference in their entirety.

TECHNICAL FIELD

The invention relates to an electrical contact device of the contact finger type for high nominal current.

PRIOR ART

A first known example of an embodiment of electrical contact of the contact finger type between a first part 10 and a second part 11 is shown in FIG. 1. The electrical contact is made up of a contact pad 12 applied on a conductive surface of the second part 11 along a contact zone 13, metal blades 14, and a flexible rod 15. Said blades, which are connected to a connection element 16 for mechanical and electrical connection to the first part 10, enable electric current to pass between the contact pad 12 and said element 16. The flexible rod 15 performs a spring function and makes it possible to provide contact force without passing electric current.

A second known example of an embodiment of electrical contact of the contact finger type consists in a one-piece contact, in which the three above-described functions of providing electrical contact, of passing electricity, and of acting as a spring are combined in a single element that is obtained for example, by machining or by die-stamping.

This second example constitutes an economical embodiment. However, a difficulty remains due to the current-passing function and the spring function being dimensioned together. The current-passing function would require a choice of materials having conductive properties suitable for limiting temperature rises: typically copper, aluminum, or alloys thereof. However, the use of such materials for providing the spring function leads to considerable limits concerning contact dimensions, notably because of the stresses and of the resulting force, in particular because of a maximum stress that must not be exceeded for the material. As a result, for a given size, said second example presents a limit value for acceptable nominal current.

The invention aims to modify such a one-piece contact, or a contact that is close in design to such a one-piece contact, in order to increase the nominal current in a given size.

SUMMARY OF THE INVENTION

The invention provides an electrical contact device of the contact finger type for high nominal current between a first part that is conductive and a conductive surface of a second part, said device comprising a flexible rod connected to a first connection element for mechanical and electrical connection to the first part, a contact portion applied on the conductive surface of the second part, and at least one metal contact blade placed at a first end between a first end of the flexible rod and the first part, the device being characterized in that the flexible rod is conductive and in that the at least one metal blade is connected at its second end to the second end of the flexible rod by means of a second mechanical and electrical connection element. The first connection element may comprise a screw or a rivet. The second connection element may comprise a rivet. The second connection element may be made by crimping and deforming a prominent portion of a contact pad. The first connection element may be connected to the first part by screw-fastening. In a first embodiment the flexible rod and the contact portion form a single piece. Advantageously, the flexible rod and the contact portion are made of copper, aluminum, or alloys thereof.

The device of the invention makes it possible to increase the nominal current for a given size.

Figure 1:
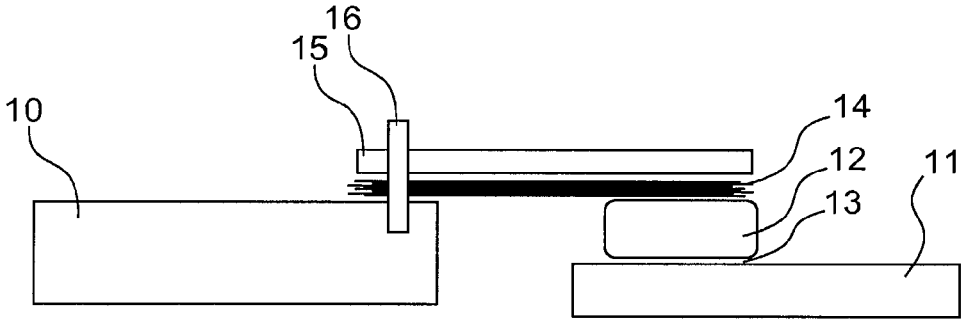
FIG. 1 (PRIOR ART)
FIG. 1 shows an example of a contact device of the prior art.
Figure 2:
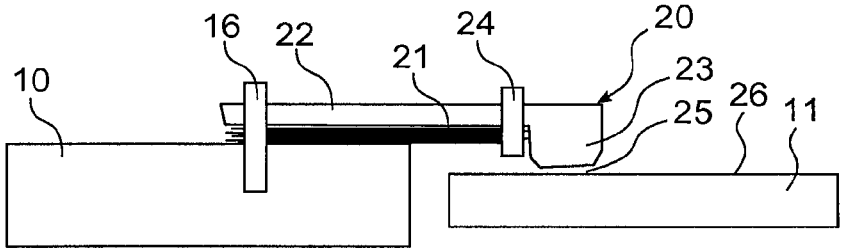
Figure 3:
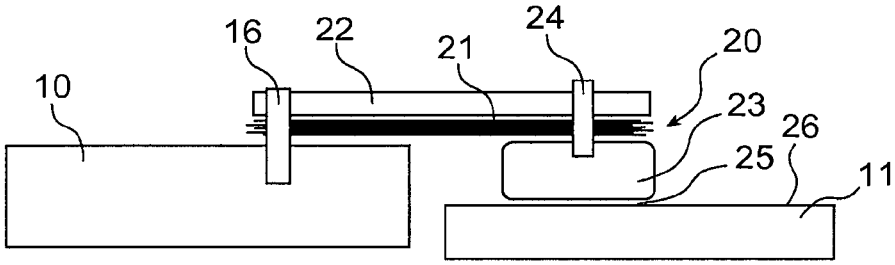

The FIGS. 2 and 3 show two embodiments of the device of the invention.

Figure 4:
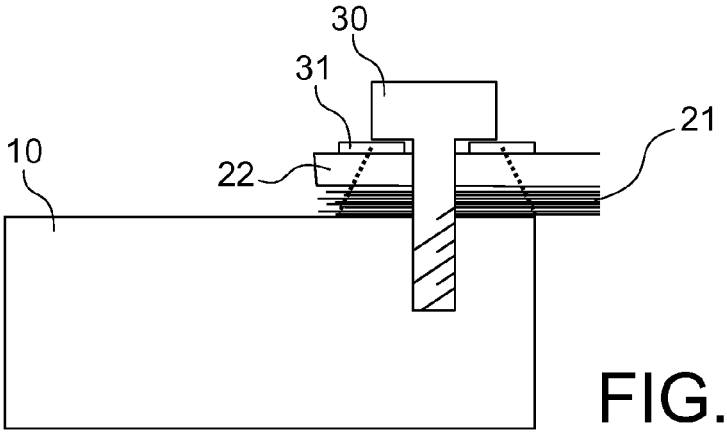
Figure 5:
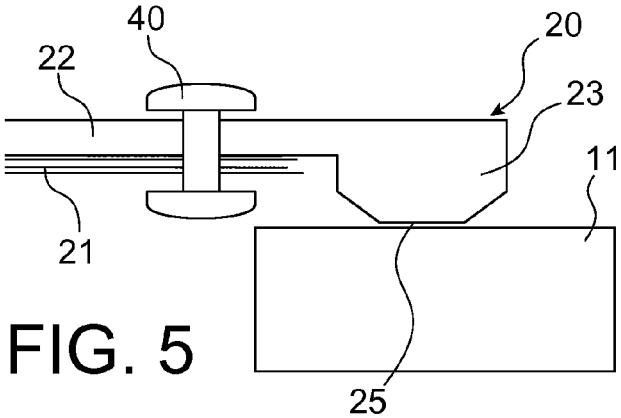
Figure 6:
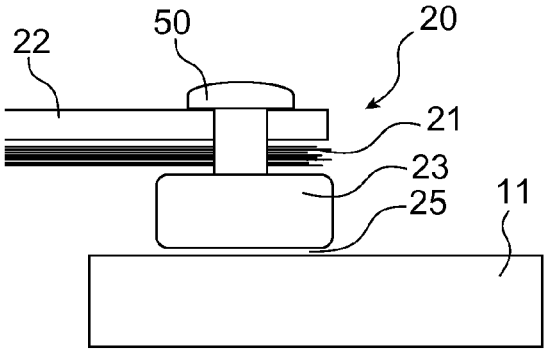

FIGS. 4 to 6 show characteristics of the device of the invention such as those shown in FIGS. 2 and 3.

DETAILED SUMMARY OF PARTICULAR EMBODIMENTS

In the device of the invention, as shown in FIGS. 2 and 3, a conductive flexible elongate contact element 20, which is the main conductor of electricity, performs a spring function and a contact pad function. It may be made as a single piece, as shown in FIG. 2, or as two pieces, as shown in FIG. 3. At least one metal blade 21 provides additional section for passing electricity in such a manner as to obtain a finger of simple structure in a given size maximizing the nominal current it can pass.

The contact element 20 comprises a first portion 22 in the form of a rod and a second portion 23 in the form of a contact pad that may form parts of a single piece or that may form two separate pieces. A first end of the at least one blade 21 is disposed between the first part 10 and the first end of the first portion of the conductive part 20, that is itself connected to said first part 10 via the connection element 16. A second end of the at least one blade 21 is connected to the second end of the first portion 22 of the contact element 20 by a mechanical and electrical connection element 24.

The at least one contact blade makes it possible to increase the nominal current without increasing the contact force.

The reference 25 designates the contact zone between the second portion 23 of the contact element 20 and the conductive surface 26 of the second part 11.

FIGS. 4 to 6 show embodiment examples of the first and second connection elements 16 and 24.

1. First Connection Element 16, Shown in FIG. 4:

This first connection element 16 may be made with the help of a screw or rivet 30 connecting the contact element 20 and the contact blade(s) 21 to the first part 10. A single link thus enables the three elements to be joined together: first part 10, metal blades 21, and contact element 20.

When the clamping force is considerable, in order to limit the compression stress in the conductive materials and/or in order to provide a satisfactory current-passing surface, a force-distribution washer 31 may be used that is placed under the screw or rivet head.

2. Second Connection Element 24, Shown in FIGS. 5 and 6:

The second connection point between the blade or blades 21 and the contact element 20 may be made either by a rivet 40, as shown in FIG. 5, or by crimping and deforming a prominent portion of a contact pad 50 inserted in the blade(s) 21 and the contact element 20, as shown in FIG. 6. Another effective solution uses screw-fastening for the two variants considered above. In any event, the same rules as those of the second point relating to the first connection element with the first part apply.

In an advantageous example embodiment, the contact element 20 may have a length lying in the range 3 centimeters (cm) to 15 cm, a thickness in its first portion 22 lying in the range 3 millimeters (mm) to 20 mm. Each metal blade may have a thickness lying in the range 0.1 mm to 1 mm. The contact element 20 and the blades may be made of copper, aluminum, or alloys thereof.

The invention claimed is:

1. An electrical contact device for high nominal current between a first part that is conductive and a conductive surface of a second part, said device comprising:

a. a flexible rod connected to a first connection element for mechanical and electrical connection to the first part, b. a contact portion applied on the conductive surface of the second part, and at least one metal contact blade placed at a first end between a first end of the flexible rod and the first part, wherein the flexible rod is conductive, wherein the at least one metal blade is connected at its second end to the second end of the flexible rod by means of a second mechanical and electrical connection element, so that to form an additional section for passing a high nominal current, and wherein the flexible rod and the contact portion form a single piece.

2. A device according to claim 1, in which the first connection element comprises a screw or a rivet.

3. A device according to claim 1, in which the second connection element comprises a rivet.

4. A device according to claim 1, in which the second connection element is made by crimping and deforming a prominent portion of a contact pad.

5. A device according to claim 3, in which the first connection element is connected to the first part by screw-fastening.

6. A device according to claim 1, in which the flexible rod and the contact portion are made of copper, aluminum, or alloys thereof.

* * * * *